United States Patent [19]

Thackray

[11] 4,454,492

[45] Jun. 12, 1984

[54] LOW INTRA-WINDING CAPACITANCE MULTIPLE LAYER TRANSFORMER WINDING

[75] Inventor: Philip C. Thackray, Gibsonia, Pa.

[73] Assignee: Laser Drive, Inc., Gibsonia, Pa.

[21] Appl. No.: 368,115

[22] Filed: Apr. 14, 1982

[51] Int. Cl.[3] ..... H01F 15/14; H01F 27/30

[52] U.S. Cl. ..... 336/69; 336/192; 336/208

[58] Field of Search ..... 336/198, 208, 192, 69, 336/70, 185; 363/126

[56] References Cited

U.S. PATENT DOCUMENTS

| | | | |
|---|---|---|---|
| 1,041,293 | 10/1912 | Keller | 336/208 X |
| 1,456,108 | 5/1923 | Johannesen | 336/208 X |
| 1,550,189 | 8/1925 | Vienneau | 336/208 X |
| 2,930,014 | 3/1960 | van der Hoek et al. | 336/198 X |
| 3,562,623 | 7/1968 | Farnsworth | 363/24 |
| 3,843,903 | 10/1974 | Miyoshi et al. | 315/31 R |
| 3,886,434 | 5/1975 | Schreiner | 336/69 X |
| 4,204,263 | 5/1980 | Onoue | 336/185 X |

FOREIGN PATENT DOCUMENTS

| | | | |
|---|---|---|---|
| 1514452 | 10/1969 | Fed. Rep. of Germany | 336/192 |
| 304063 | 9/1968 | Sweden | 336/208 |

*Primary Examiner*—Thomas J. Kozma

*Attorney, Agent, or Firm*—Buell, Blenko, Ziesenheim & Beck

[57] ABSTRACT

The transformer is wound with multiple layers of the same number of turns extending across the bobbin and with the leads from each layer brought out through each end of the bobbin. The individual layers are wound with each turn immediately abutting the preceding turn and successive layers are wound on top of each other so that the turns of the upper layer lie in the furrows or valleys between the turns of the layer immediately below. The distance between the wires of the underlying and overlying layers normal to the bobbin surface is less than the diameter of the wire, and to overcome this difficulty each lead is arranged in echelon with the lead above and below it. Slot configurations for bobbins of both flat sided and cylindrical cores are developed.

12 Claims, 5 Drawing Figures

LOW INTRA-WINDING CAPACITANCE MULTIPLE LAYER TRANSFORMER WINDING

This invention relates to high voltage-high frequency power transformers for providing power to pulsed or continuous high voltage loads. It is more particularly concerned with such transformers having reduced stray capacitances and maximum copper packing factors so as to provide corona-free voltage.

BACKGROUND OF THE INVENTION

It is well-known that inter-and intra-winding capacitances limit the effective operation of high frequency voltage transformers. A circuit arrangement which in effect shorts out inter-winding capacitances is disclosed in Farnsworth U.S. Pat. No. 3,562,263. This circuit, known as the "diode split" circuit, utilizes multiple high voltage windings connected in series through diodes. The circuit, however, does not reduce intra-winding capacitances and in high voltage-high frequency power transformers so constructed the intra-winding capacitances become the limiting capacitance factors.

There are two generally employed ways to wind multiple winding transformers. The bobbin may be divided into sections by spacers parallel to its end plates and each section so provided wound in layers, or each layer may extend across the full width of the bobbin and successive layers are wound one on top of each other. The first type of winding is illustrated in Miyoshi et al., U.S. Pat. No. 3,843,903, specifically FIG. 7, and the second in Schreiner U.S. Pat. No. 3,886,434, specifically FIGS. 5A and 5B. In sectionalized windings the coupling between windings is not as close as it is in layer windings and the copper packing factor is somewhat less than is obtained in layer winding.

It has generally been the practice in layer winding of transformer coils to cover each layer with a strip of insulating material so as to provide a smooth surface for the succeeding layer. This construction permits the winding to be brought out as a lead at each end of the bobbin. However, unless the insulating strip is of appreciable thickness the surface of each successive layer becomes more and more irregular, so that the sequence cannot be used in a product environment when a large number of layers is required. If the separating strips are made thick enough and stiff enough to provide smooth winding surfaces the packing factor and the coupling are appreciably diminished.

It is also well-known that the maximum coupling between windings of power transformers is desirable. As the diode split circuit neutralizes the inter-winding capacitances of multiple layer windings it simplifies the design of such transformers. One arrangement is disclosed in the Schreiner patent previously mentioned. A single layer winding has the lowest intra-winding capacitance and if several single layer windings are superimposed and connected in the diode split circuit, the overall stray winding capacitance should be merely the individual intra-winding capacitances in series. Prior to my invention to be described hereinafter, however, no such winding arrangement with which I am familiar has fully realized the expected improvement. Those skilled in the art know that the intra-winding capacitance of a winding cannot be measured directly but can be calculated from the resonant frequency of the coil-intra-winding capacitance combination and the low-frequency inductance of the coil. Multiple layer power transformers so far constructed all have considerably lower resonant frequencies than would be expected from the measured resonant frequencies of their individual layer windings.

THE INVENTOR'S SOLUTION TO THE PROBLEM

I have found that the magnetic coupling and copper packing factor of a high voltage transformer are maximized and the intra-winding capacitances are minimized by a winding comprising multiple layers of the same number of turns extending across the bobbin, wound one on top of the other in a way to be described hereinafter, and with the leads from each layer brought out in the way to be described hereinafter. The individual layers are wound closely and evenly, that is, each turn immediately abutting the preceeding turn, and successive layers are wound on top of each other so that the turns of the upper layer lie in the furrows or valleys between the turns of the layer immediately below. Each layer extends across the bobbin and its leads are brought out, one at each end, through the bobbin end walls. As each layer after the first layer lies between the furrows of the layer below it and the furrows of the layer above it, the distance between the wires of the underlying and overlying layers normal to the bobbin surface is appreciably less than the diameter of the wire. Prior to my invention hereinafter disclosed this difference has stood in the way of winding successive layers of wire in the manner above described and bringing the wire out at each end of each layer through the bobbin ends. I overcome this difficulty by offsetting the point of exit of each lead from the lead below so as to position those leads in echelon.

DESCRIPTION OF PREFERRED EMBODIMENT—FLAT SIDED BOBBIN

Figure 1:
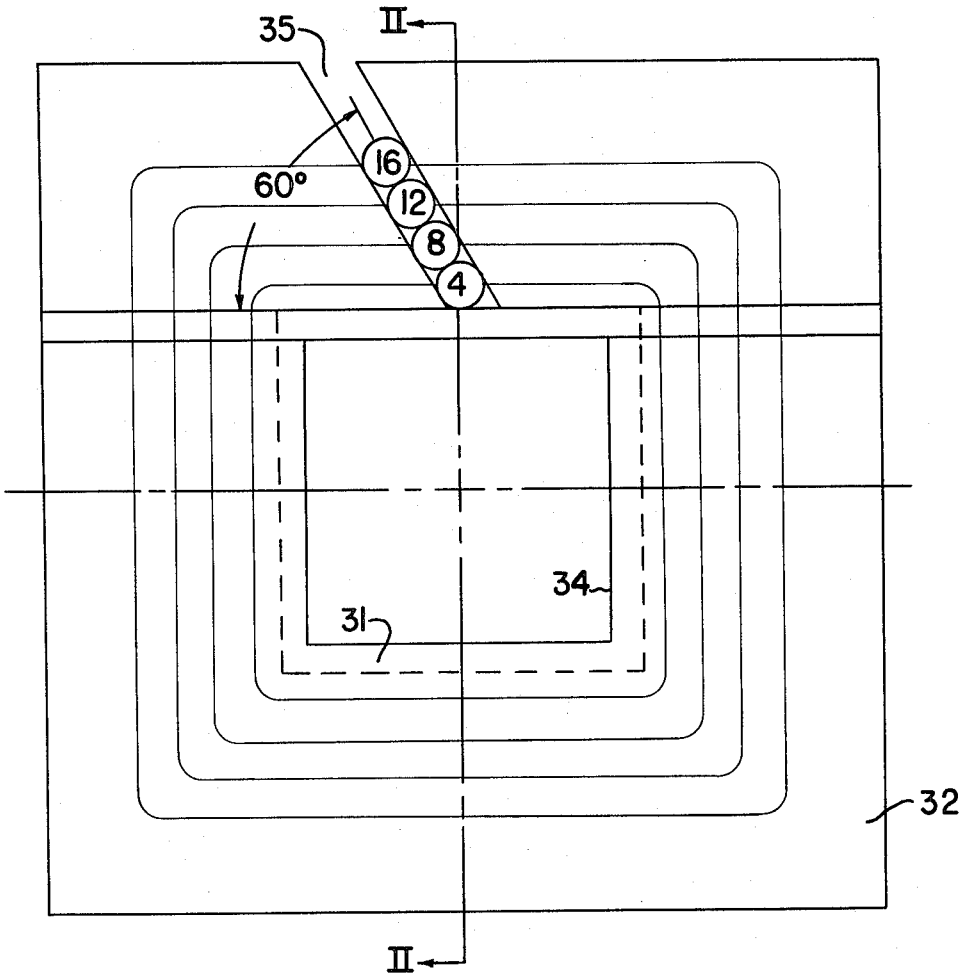
FIG. 1 is an end elevation of a flat sided bobbin wound in accordance with my invention.
Figure 2:
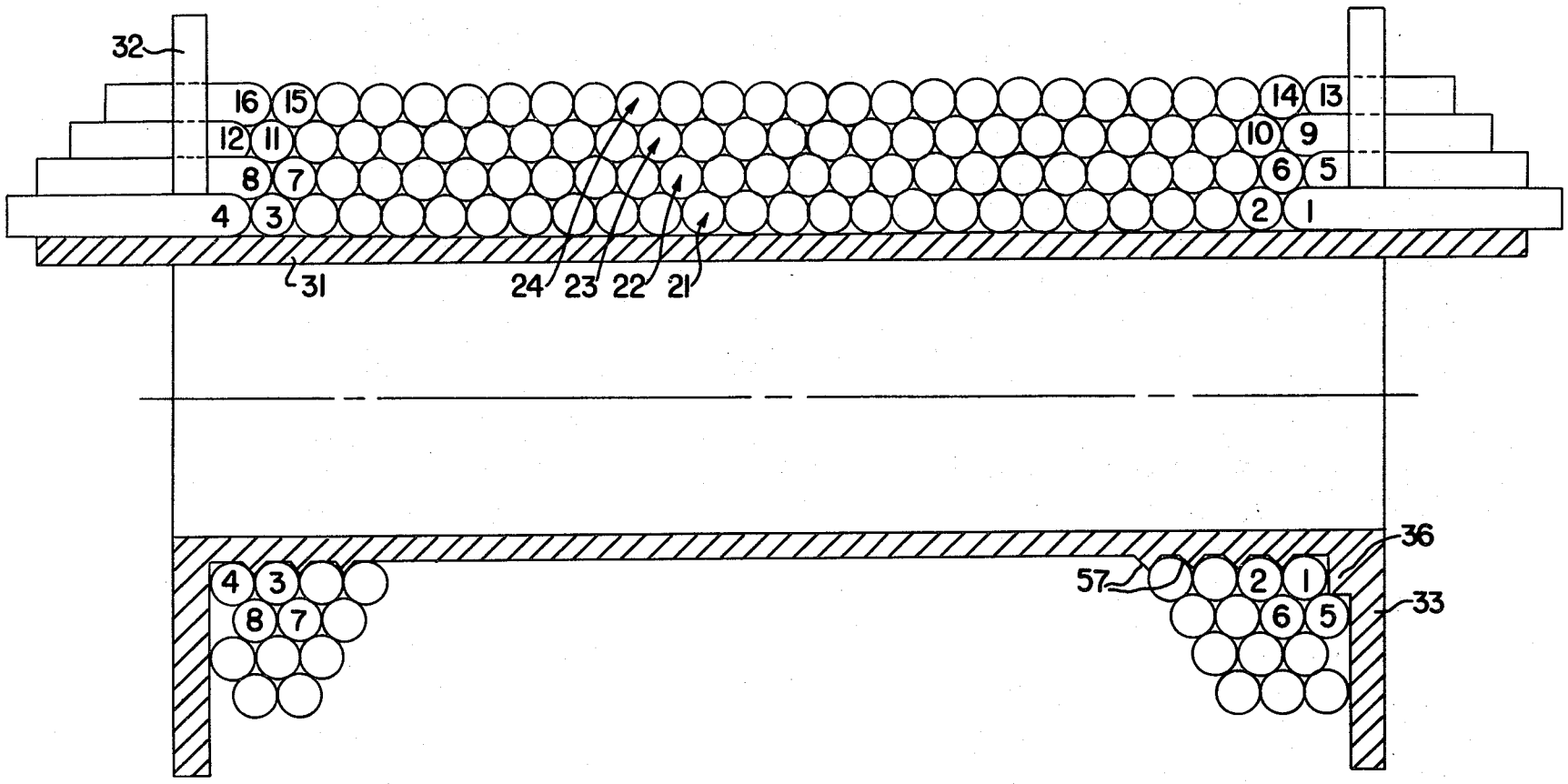
FIG. 2 is a vertical cross section through the bobbin of FIG. 1.

A bobbin shown in FIGS. 1 and 2 has a core 31 of square or rectangular cross section and two flat ends 32 and 33, each having a cutout 34 dimensioned to match core 31 and fit over a transformer core leg. Each bobbin end 32 and 33 is also formed with a slot 35 to bring out leads from the winding. The first layer of wire 21 wound on core 31 has a first turn 1 adjacent bobbin end 33 and a second turn 2 wound against turn 1. At the other end of the winding turn 4 is the last turn wound against bobbin end 32 and turn 3 is the next to the last turn wound against turn 4. Layer 22, immediately above layer 21, has a first turn 5 above turn 1 but offset therefrom toward bobbin end 33 so as to rest against that end. To effect this offset bobbin end 33 is formed with an internal annular ledge 36 adjacent core 31 having a dimension normal to core 31 slightly less than the diameter of the wire and a dimension parallel to core 31 of ½ the wire diameter. The exact value of the dimension of ledge 32 normal to core 31 will be developed hereinafter. Turn 5 is supported both by ledge 33 and turn 6. Turn 6 is wound abutting turn 5, in the furrow or valley between turns 1 and 2. Layer 22 is wound in this way across the bobbin, turn 8, its last turn, being wound in the furrow between turns 3 and 4 immediately below.

Turn 1 is brought out as a lead at the bottom of slot 35 in bobbin end 33 and turn 4 is brought as a lead at the bottom of slot 35 in bobbin end 32. Turn 5 of layer 22 is brought out as a lead through slot 35 in bobbin end 33 and turn 8 is brought out as a lead through slot 35 in bobbin end 32. As is shown in FIG. 1 slot 35 is not normal to the surface of core 31 immediately below it. Layer 23 is wound on top of layer 22 with turn 9, its first turn, positioned in the furrow between turns 5 and 6 of layer 22. It is thus positioned in the same plane as turn 1. Turn 9 is brought out as a lead in the slot 35 of bobbin end 33 and turn 12, its last turn, which is in the same plane as turn 4, is brought out as a lead in the slot 35 of bobbin end 32. Slot 35 is inclined to the bobbin surface sufficiently that the space in the slot between turns 4 and 12 allows turn 8 to be brought out as a lead between them. It will be evident that any number of layers of wire can be wound on a bobbin in the above manner and that each layer will be positioned with respect to the layer below it and the layer above it in exactly the same way as all other layers. The distributed capacitance of each layer will, of course, be somewhat greater than that of the layer below it because of the greater length of wire in each successive layer, but this increase will be uniform and the aggregate distributed or intra-winding capacitance of a coil so wound will be the minimum for this type of winding permitted by the coil size and shape and the wire size chosen.

Figure 3:
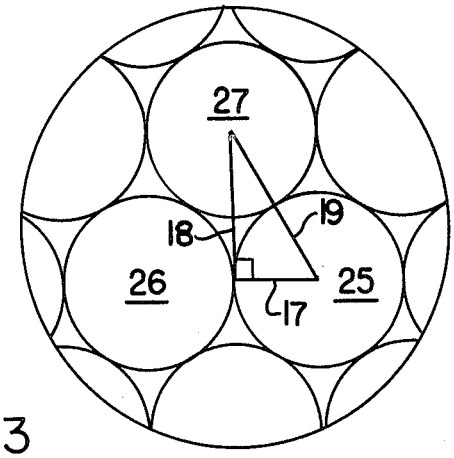
FIG. 3 is an enlarged detail of FIG. 2.

The angle of inclination of slot 35 is determined by the geometry of adjoining turns of the wire in the superimposed windings, and is illustrated in FIG. 3, which is an enlarged detail cross section taken anywhere inside the coil of FIG. 2. Turns 25 and 26 are adjoining turns of any layer. Turn 27 is the turn of the layer immediately above which is wound in the furrow between turns 25 and 26. Line 18 is tangent to turns 25 and 26 and is drawn to the center of turn 27. Line 17 is a radius of turn 25 normal to line 18. Its length is obviously d/2. Line 19 is drawn from the center of turn 25 to the center of turn 27. Its length is obviously d. The angle between lines 17 and 18 is a right angle and the three lines form a right triangle having a hypotenuse twice the length of its base. Therefore the angle between lines 17 and 19 is 60° and the length of line 18 from line 17 to line 19 must be $\sqrt{3}d/2$. This is the distance normal to the bobbin core surface between successive layers of wire, and also of the ledge 33. Turn 27 is offset from turn 25 parallel to the core surface by d/2, and every other turn in the same layer is so offset from the wire below it, as is the lead from the layer including turn 27 from the lead from the layer including turns 25 and 26.

If end turns 4, 8, 12 and 16 are to exit as leads through bobbin end 32 at the same levels as layers 21, 22, 23 and 24 respectively the centers of adjoining leads will be separated by only $\sqrt{3}d/2$, which is insufficient to permit vertical stacking of the leads. However, if those adjoining leads are offset from each other horizontally by d/2, the same amount as are the wires in FIG. 3, the centers of the leads lie on a line inclined at 60° to the surface of bobbin core 31 and the leads are disposed in echelon. Slot 35 is therefore inclined at that angle. Its width, of course, must be somewhat greater than d.

DESCRIPTION OF PREFERRED EMBODIMENT—CYLINDRICAL BOBBIN

Figure 4:
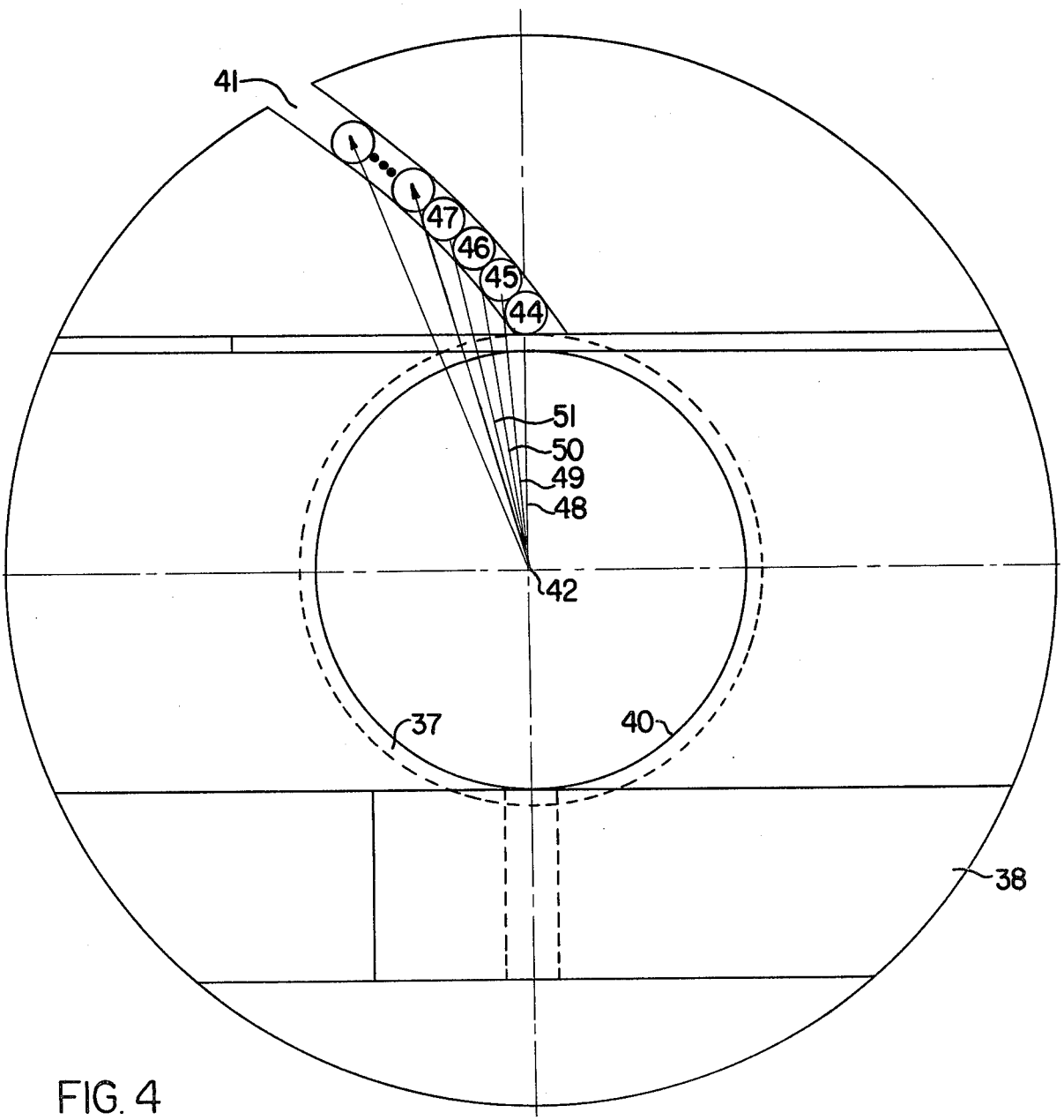
FIG. 4 is an end elevation of a cylindrical bobbin wound in accordance with my invention.
Figure 5:
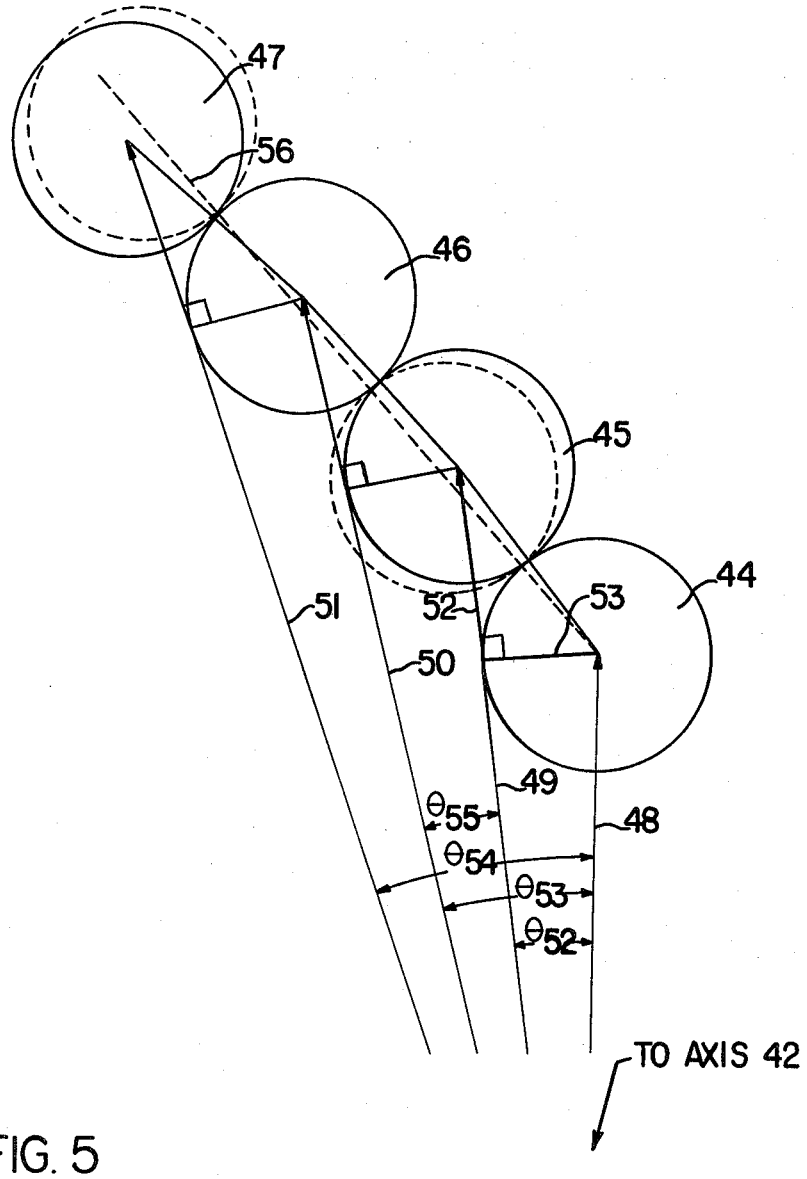
FIG. 5 is an enlarged detail of FIG. 4.

A longitudinal cross-section through a coil of my invention wound on a cylindrical bobbin looks no different from the longitudinal cross section of a coil wound on a flat sided bobbin of FIG. 2. The geometry of the wires in adjoining layers is the same for a winding on a cylindrical core as is shown in FIG. 3 for a winding on a core of square or rectangular cross section. The end elevation of a coil of my invention wound on a circular core bobbin is shown in FIG. 4. The bobbin has a cylindrical core 37 having an axis 42 and two flat ends with cutouts to fit core 37. End 28 with cut out 41 is shown. Each end is formed with a slot 41 to bring out leads from the windings. The first layer of wire, similar to layer 21 previously described, has a lead 44 brought out through slot 41 which lead is the extension of the last turn of the winding adjacent bobbin end 38. The next layer immediately above, similar to layer 22, has its last turn 45 brought out as a lead above turn 44 through slot 41, and leads 46 and 47 from the third and fourth winding layers are brought out in that way through slot 41, above turn 45. Slot 41 is inclined to the bottom surface sufficiently that the space in the slot between turns 44 and 46 allows turn 45 to be brought out in echelon as a lead between them. Radius 49 of lead 45 is tangent to lead 44, radius 50 of lead 46 is tangent to lead 45, and radius 51 of lead 47 is tangent to lead 46. The geometrical relation between the above mentioned leads is shown in enlarged detail in FIG. 5. It is immediately evident that it differs only from FIG. 3 in that the lines 48 through 51 of FIG. 5 are radial whereas line 18 of FIG. 3, and all other lines which can be drawn in the same way, are parallel to each other. Line 53, equal to d/2, is drawn to point of tangency of radius 49 with lead 44. The angle between radii 48 and 49 or between radii 49 and 50 or between radii 50 and 51 is arctan d/2r where r is radius 48, 49 or 50, respectively. Thus the angle between successive radii becomes smaller the farther the lead is from the bottom of slot 41. $\theta$, the angle between successive radii, is 0 for the first lead, and for any lead m is given by the equation $\theta=\theta_{(m-1)}+\text{arctan } d/2r$ where r is the radius to the previous lead and $m\geqq 2$. Line 52, that portion of radius 49 between the center of lead 45 and the points of tangency of radius 49 to lead 44 is equal to $\sqrt{3}d/2$ and the same is true of the corresponding portions of radii 50 and 51. Thus the radius of each lead is longer than the radius of the lead next to it nearer the bottom of slot 41 by the amount $\sqrt{3}d/2$. The length of any radius $r_m$ is, therefore, given by the equation $r_m=r_1+(m-1)\sqrt{3}d/2$ for $m\geqq 1$ where $r_1$, is the radius of the lead from the first layer of the coil.

The angle $\theta_{52}$ between radii $r_{48}$ and $r_{49}$ is arctan $d/2r_{48}$. The angle $\theta_{53}$ between radii $r_{48}$ and $r_{50}$ is angle $\theta_{52}$ plus $\theta_{55}$, where the latter is the angle between $r_{49}$ and $r_{50}$. But angle $\theta_{55}=\text{arctan } d/2r_{49}$. Radii $r_{49}$, $r_{50}$ and $r_{51}$ are successively longer than $r_{48}$. The radius of the last lead m can be written $r_m=r_1+(m-1)\sqrt{3}d/2$ for $m\geqq$than 1. The angle $\theta_m$ between $r_m$ and $r_{48}$ can be written $\theta_m=\theta_{(m-1)}+\text{arctan } d/2r_{(m-1)}$ for $m\geqq 2$. Slot 41 is curvilinear.

The conditions or equations above developed are intended to determine the location of exit leads for each layer so that the winding surface of the coil is not disturbed by the lead location. A perfectly level winding surface for each layer is the optimum condition. It is not difficult with a well designed bobbin to hold variation of lead location to less than 15% of the wire diameter, but greater tolerances, up to about one wire diameter, are admissable. This tolerance makes possible a simplified design of slot for cylindrical bobbins where the number of layers of wire is not great. In FIG. 5 the dash line 56 is a straight line passing through the center of the first lead 44 and intersecting the center line of curvilinear slot 41 at a point between the centers of leads 46 and 47. This line represents the center line of a straight-sided slot such as slot 35 previously described herein.

It will be seen that if lead 45 is swung downwardly remaining tangent to lead 44, until its center is on line 56 it assumes the position shown in dash lines. If lead 46 is to remain tangent to lead 45 in its new position it will also move downwardly until its center lies on line 56. As this displacement, as shown, is very small, new position of line 46 is not shown in the figure. Lead 47, however, to remain tangent to lead 46 in its new position will be swung upwardly until its center lies on line 56, to assume the position shown in dash lines. Thus the leads can be brought out through a straight-sided but inclined slot, the center line of which is line 56. The radius of lead 45 in its new position to axis 42 will be shorter than its radius 49. The radius of lead 46 in its new position will also be somewhat shorter than radius 50, by a smaller amount, but the radius of lead 47 in its new position will be longer than radius 51. Thus the leads will not be brought out at the same radii from the axis of the core as the turns in their respective layers. In FIG. 5 the displacements are small and are more or less evenly balanced above and below line 56 so that the winding surface of the coil is not disturbed sufficiently to increase its intra-winding capacitance unduly. If line 56 is drawn so that the differences between the radii to the core axis of each exit lead and the radius of its winding is not greater than about 1 diameter, and those differences are reasonably balanced plus and minus, the effect on the distributed capacitance of the coil can be tolerated.

In order to wind uniformly smooth layers of wire of n turns on the bobbin core the inside length of the bobbin between ends must be n times the diameter of the wire plus d/2. This extra space allows for the offset between successive wire layers. As has been mentioned ledge 36, shown in FIG. 2, is made with a width of d/2. It is also desirable to form the bobbin core with a series of annular ridges 57 extending the inside length of the bobbin, shown in FIG. 2. Ridges 57 are triangular in cross section and are spaced from each other so that successive ridges form channels in which the turns of the bottom layer 21 of the winding lie uniformly spaced abutting each other. Ridges 57 are each interrupted for an interval, so as to permit crossover of the spirally wound turns.

While I have shown and described a present preferred embodiment of the invention it is to be distinctly understood that the invention is not limited thereto, but may be otherwise variously embodied within the scope of the following claims.

I claim:

1. In a multiple layer transformer winding comprising a bobbin, a plurality of superimposed layers of round wire closely wound on the bobbin core and extending from end to end of the bobbin, each layer having its ends brought out as leads through opposite ends of the bobbin, the improvement comprising evenly superimposed layers of the same number of turns of wire of the same diameter d, each turn of each layer above the bottom layer being positioned in the furrow between abutting turns of the layer below and each lead being parallel to the lead below but displaced therefrom in the same direction parallel to the bobbin core surface by substantially d/2.

2. The winding of claim 1 in which the inside length of the bobbin between ends is an integral number of wire diameters plus d/2 and including an internal annular ledge adjacent the bobbin core and a bobbin end having a width d/2 and a height $\sqrt{3}d/2$.

3. The winding of claim 1 in which the bobbin core is formed with a spiral ridge defining a spiral channel having the same pitch as the transformer winding and serving to position the turns of the bottom layer wound thereon evenly adjacent each other.

4. The winding of claim 1 in which the bobbin core has flat sides and a line through the centers of successive leads on the same end of the bobbin is a substantially straight line.

5. The winding of claim 4 in which the substantially straight line is inclined to the bobbin surface below the leads at an angle of substantially 60°.

6. The winding of claim 1 in which the bobbin core is a cylinder and a line through the centers of successive leads at the same end of the bobbin is curvilinear, concave toward the axis of that cylinder.

7. The winding of claim 6 in which the radii from the bobbin axis to the centers of successive leads are tangent to the preceding leads respectively.

8. The winding of claim 7 in which each successive radius is greater in length than the radius preceeding it by an amount equal to $\sqrt{3}d/2$.

9. The winding of claim 7 in which the angle $\theta_m$ between any two successive radii is given by the equation $\theta m = \theta(m-1) + \arctan d/2r_{(m-1)}$ for $m \geqq 2$, where $r_m$ and $r_{(m-1)}$ are the radii defining $\theta_m$.

10. The winding of claim 1 in which the bobbin core is a cylinder, a line through the centers of successive leads at the same end of the bobbin having radii from the bobbin axis to their centers tangent to their preceding leads respectively is curvilinear, concave toward the bobbin axis, and in which the bobbin ends are each formed with a straight-sided slot for said leads, the center line of said slot passing through the center of the first lead adjacent the core and intersecting said curvilinear line so that its maximum deviations from said curvilinear line on each side are approximately equal.

11. The winding of claim 1 in which the bobbin core is a cylinder, a line through the center of successive leads at their junction with their respective layers at the same end of the bobbin and having radii from the bobbin axis to their centers tangent to their preceding leads respectively is curvilinear, concave toward the bobbin axis, and in which the bobbin ends are each formed with a straight-sided slot for said leads through which the leads are passed in echelon, thereby displacing at least some of those leads from the levels of their respective layers, the center line of said slot passing through the center of the first lead and intersecting said curvilinear line so that the maximum differences in radii from the bobbin axis to the centers of the displaced leads above and below said center line from their corresponding radii at their junctions with their respective layers are approximately equal.

12. The winding of claim 11 in which the maximum differences are not greater than about one wire diameter.

* * * * *

UNITED STATES PATENT AND TRADEMARK OFFICE

CERTIFICATE OF CORRECTION

PATENT NO. : 4,454,492

DATED : June 12, 1984

INVENTOR(S) : Philip C. Thackray

It is certified that error appears in the above-identified patent and that said Letters Patent is hereby corrected as shown below:

Column 1, line 17, "Pat. No. 3,562,263" should be --Pat. No. 3,562,623--.

Column 4, line 46, "points" should be --point--.

Signed and Sealed this

*Twenty-third* Day of *October 1984*

[SEAL]

*Attest:*

GERALD J. MOSSINGHOFF

*Attesting Officer*

*Commissioner of Patents and Trademarks*